US007777147B2

(12) United States Patent
Wong et al.

(10) Patent No.: US 7,777,147 B2
(45) Date of Patent: Aug. 17, 2010

(54) ELECTRICAL SWITCH AND FIXED CONTACT THEREFOR

(76) Inventors: Memie Mei Mei Wong, 7th Floor, Block 2, Leader Industrial Centre, 188-202 Texaco Road, Tsuen Wan, New Territories (HK); Sam Yun Sum Wong, 7th Floor, Block 2, Leader industrial centre, 188-202 Texaco Road, Tsuen Wan, New Territories (HK)

( * ) Notice: Subject to any disclaimer, the term of this patent is extended or adjusted under 35 U.S.C. 154(b) by 1158 days.

(21) Appl. No.: 11/340,568

(22) Filed: Jan. 27, 2006

(65) Prior Publication Data

US 2007/0175742 A1 Aug. 2, 2007

(51) Int. Cl.
*H01H 19/20* (2006.01)

(52) U.S. Cl. ..... 200/571; 200/11 R; 200/11 G

(58) Field of Classification Search ..... 200/11 R–11 K, 200/6 R–6 C, 16 R–16 D, 564, 565, 570, 200/571, 283
See application file for complete search history.

(56) References Cited

U.S. PATENT DOCUMENTS 3,748,419 A * 7/1973 Torrey et al. ..... 200/570
4,059,738 A * 11/1977 Mongeau ..... 200/6 B
4,450,323 A * 5/1984 Iitsuka ..... 200/1 V
4,996,401 A 2/1991 Park
5,343,004 A * 8/1994 Chen ..... 200/11 R
5,581,059 A * 12/1996 Chang ..... 200/11 G
5,728,982 A * 3/1998 Rao et al. ..... 200/6 R
5,750,947 A * 5/1998 Rao et al. ..... 200/6 R
5,811,745 A * 9/1998 Hung ..... 200/11 R
6,265,681 B1 * 7/2001 Aromin ..... 200/570
6,605,787 B1 * 8/2003 Chu ..... 200/11 G
6,740,833 B1 * 5/2004 Lai ..... 200/570
2007/0235314 A1 10/2007 Wong et al.

FOREIGN PATENT DOCUMENTS

GB 2 300 758 A 11/1996

* cited by examiner

*Primary Examiner*—Michael A Friedhofer
(74) *Attorney, Agent, or Firm*—Leydig, Voit & Mayer, Ltd.

(57) ABSTRACT

An electrical rotary switch has a rotor with a periphery, a moving contact on the rotor and several connected parts adjacent the rotor periphery, and four fixed contacts around the rotor for short-circuiting by the moving contact. Each fixed contact has first, second, and third integrally connected sections. The first section bears resiliently against the rotor periphery for sliding contact with the moving contact parts. The second section turns through an angle larger than 135° from the first section. The third section turns through an angle smaller than 90° from the second section for connection of an electrical cable by self-gripping. The moving contact has an undulating profile matching with that of an adjacent part of the rotor periphery.

49 Claims, 9 Drawing Sheets

ELECTRICAL SWITCH AND FIXED CONTACT THEREFOR

The present invention relates to an electrical rotary switch and a fixed switch contact therefor.

BACKGROUND OF THE INVENTION

An electrical switch of the type concerned has a casing, a rotor therein, a moving contact mounted on the rotor for rotation, and a plurality of fixed contacts in the casing for short-circuiting by the moving contact. The casing is typically of a flat square shape, with each of the four corners locating a fixed contact. Whilst there is an ongoing demand for a smaller sized switch, the contacts inside must be separated by a certain minimum distance so as to meet the relevant safety standard requirements. Considerations as to various parts and aspects of the switch are warranted before improvements can be made.

The invention seeks to provide an improved electrical rotary switch and a fixed switch contact therefor.

SUMMARY OF THE INVENTION

According to a first aspect of the invention, there is provided an electrical rotary switch comprising a casing, a rotor supported within the casing for rotation about an axis and having a periphery surrounding the axis, a moving contact mounted on the rotor for rotation therewith and having a plurality of connected parts adjacent the rotor periphery, and a plurality of fixed contacts located laterally of the rotor for short-circuiting by the moving contact. At least one of the fixed contacts comprises a series of first, second and third integrally connected sections. The first section bears resiliently against the rotor periphery for sliding contact with the moving contact parts. The second section turns through an angle larger than 135° from the first section. The third section turns through an angle smaller than 90° from the second section for connection of an electrical cable.

Preferably, said at least one fixed contact subtends an angle larger than 180°.

It is preferred that the second section turns from the first section in one direction and the third section turns from the second section in the opposite direction.

Preferably, the second section turns from the first section through an angle of substantially 180°.

More preferably, the second section turns from the first section through two curved bends each of an angle of substantially 90°.

Further more preferably, the two bends are integrally interconnected by a relatively short intermediate section of said at least one fixed contact, the intermediate section being substantially flat.

It is preferred that the first section is longer than the second section.

It is preferred that the second section is considerably shorter than the first section.

In a preferred construction, the first section has a substantially flat first portion adjacent the second section and a curved second portion which is curved smoothly outwardly from the second section and then smoothly inwardly to provide a convex end bearing resiliently against the rotor periphery for sliding contact with the moving contact part, the second portion being considerably longer than the first portion.

Preferably, the second section is substantially flat.

Preferably, the third section turns from the second section through an angle between 40° and 50°.

In a preferred embodiment, the casing has an internal partition that extends between the first section and the second section.

More preferably, the partition extends along almost the entire length of a gap between the first section and the second section.

Further more preferably, the casing has a wall that extends along opposite sides and round an end of the partition, together defining a channel receiving part of the first and second sections.

Yet further more preferably, said part of the first and second sections is in contact with the wall.

In a preferred embodiment, the casing has an internal partition that extends between the rotor and first section and the third section.

More preferably, the casing has a wall connected to the partition, together defining a substantially closed cavity behind the third section.

It is preferred that the casing has a hole behind which the third section is located, the third section being at least in part resiliently bendable inwardly by said cable upon insertion through the hole, thereby gripping said cable against withdrawal.

It is preferred that the electrical rotary switch includes a plurality of said at least one fixed contacts, each of the fixed contacts being separated from the other fixed contact or contacts by a distance of at least 6 mm.

In a preferred embodiment, the electrical rotary switch includes two said at least one fixed contacts, wherein the rotor has a side radially extending about the axis, and the moving contact has a portion at the said side of the rotor and connected with the parts of the moving contact, wherein an additional fixed contact is located generally between the two fixed contacts, which has an inner part in continuous sliding contact with the portion of the moving contact and an outer part for connection of an electrical cable.

More preferably, each of the two fixed contacts subtends an angle larger than 180° and has an open side facing that of the other fixed contact, between which open sides the additional fixed contact is located.

More preferably, the additional fixed contact is located within the same interior of the casing as the other fixed contacts.

Further more preferably, the casing has two parts connected together to define the interior therebetween.

It is preferred that the additional fixed contact is separated from the fixed contact on each side by a distance of at least 3 mm.

The casing is preferably of a substantially flat square shape, having four corners each housing one respective said fixed contact.

According to a second aspect of the invention, there is provided an electrical contact for use in an electrical switch, comprising a contact portion for making contact with or breaking contact from another electrical contact in said switch to perform switching, and a terminal portion connected to the contact portion for connection of an electrical cable. The terminal portion comprises a first section and a second section. The first section has a tab and a link, the tab being bendable against own resilience out of a plane of the first section, resulting in a void in the first section. The second section is integrally connected to the first section by the link and provided adjacent the tab such that upon being bent out of the plane of the first section by an end of said electrical cable passing through said void, the tab resiliently grips and presses said cable end against the second section, resulting in said cable end being connected on opposite sides thereof.

Preferably, the second section has a surface adjacent the tab and facing the tab while bent, against which surface the tab while bent is to press said cable end.

More preferably, the second section turns from the first section through an angle of about 90°.

It is preferred that the tab has an integrally connected first end about which the tab is bendable, and a free second end adjacent the second section for gripping and pressing said cable end against the second section.

It is further preferred that the tab extends from its first end to its second end in a direction substantially parallel to the link.

In a preferred embodiment, the tab and the link are provided side-by-side in a direction transversely of the first section.

More preferably, the tab and the link occupy the entire width of the first section.

It is preferred that the tab is separate from the rest of the first section by a substantially L-shaped cut.

It is further preferred that the substantially L-shaped cut extends partially along the length and width of the first section.

Preferably, the void is open on one side of the first section opposite the link.

Preferably, each of the first and second sections is substantially planar.

Preferably, the second section is situated at a free end of the electrical contact.

According to a third aspect of the invention, there is provided an electrical rotary switch comprising a casing, a rotor supported within the casing for rotation about an axis and having a side radially extending about the axis and a periphery surrounding the axis, the periphery having a undulating profile, a moving contact mounted on the rotor for rotation therewith, and a plurality of fixed contacts located laterally of the rotor bearing resiliently against the rotor periphery for sliding contact with the moving contact so as to be short-circuited thereby. The moving contact comprises a base at the rotor side and a plurality of parts adjacent the rotor periphery for contact by the fixed contacts. The parts are integrally connected to the base and folded therefrom to extend substantially parallel to the axis. At least one of the parts has an undulating profile matching with that of an adjacent part of the rotor periphery.

Preferably, the undulating profile of the rotor periphery comprises alternating crests and valleys, and the undulating profile of said at least one part of the moving contact extends continuously over at least two adjacent said valleys.

Preferably, the undulating profile of the rotor periphery comprises alternating crests and valleys, and the undulating profile of said at least one part of the moving contact comprises at least two adjacent valleys matching with that of the rotor periphery.

It is preferred that the moving contact fits over the rotor, with its base lying on the rotor side and its periphery meeting the rotor periphery.

It is preferred that the profile of said at least one part of the moving contact is slightly expanded from that of an adjacent part of the rotor periphery for contact by the fixed contacts.

It is preferred that the moving contact is produced by way of a deep-draw manufacturing process from a blank of material.

The casing is preferably of a substantially flat square shape, having four corners each housing one respective said fixed contact.

According to a fourth aspect of the invention, there is provided an electrical rotary switch comprising a casing, a rotor supported within the casing for rotation about an axis and having a side radially extending about the axis and a periphery surrounding the axis, a moving contact mounted on the rotor for rotation therewith, having a base at the rotor side and a plurality of parts adjacent the rotor periphery, and at least two fixed contacts located laterally of the rotor bearing resiliently against the rotor periphery for sliding contact with the parts of the moving contact so as to be short-circuited thereby. An additional fixed contact is located generally between the two fixed contacts, which has an inner portion in continuous sliding contact with the base of the moving contact and an outer portion for connection of an electrical cable.

Preferably, the additional fixed contact is located within the same interior of the casing as the other fixed contacts.

More preferably, the casing has two parts connected together to define the interior therebetween.

More preferably, the casing includes a tubular protrusion projecting laterally therefrom and housing the additional fixed contact, the protrusion being substantially aligned in terms of thickness with the casing.

It is preferred that the outer portion of the additional fixed contact has integrally connected first and second parts for gripping an end of said cable therebetween, the first part being bendable against own resilience inwardly by said cable end upon insertion to thereby engage said cable end at an angle inwardly and press it against the second part.

It is further preferred that the first part of the outer portion of the additional fixed contact is folded backwards to point at an angle inwardly at the second part, for connecting said cable end therebetween.

More preferably, the outer portion of the additional fixed contact has a hole between the first and the second parts for insertion of said cable end through to reach between the first and the second parts.

The casing is preferably of a substantially flat square shape, having four corners each housing one respective said fixed contact and having four sides through one of which the additional fixed contact extends.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
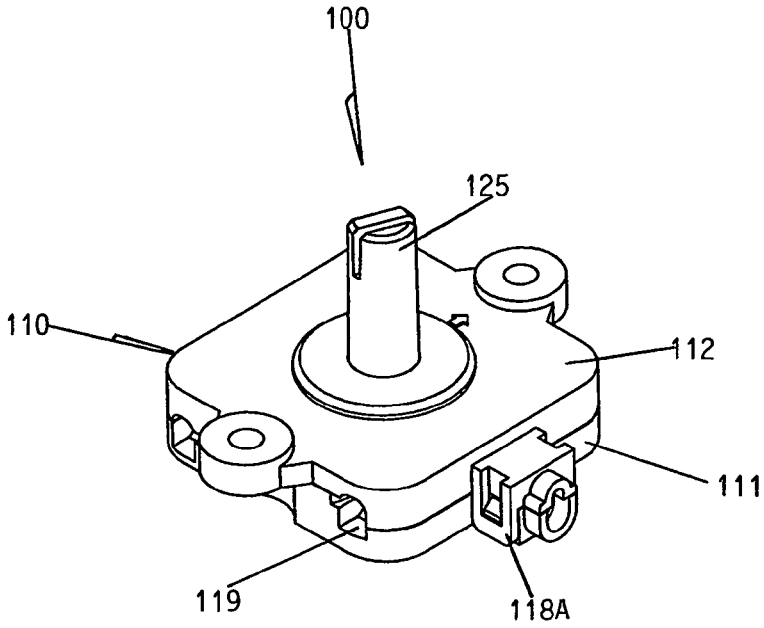
FIG. 1 is a top perspective view of an embodiment of an electrical rotary switch in accordance with the invention.
Figure 2:
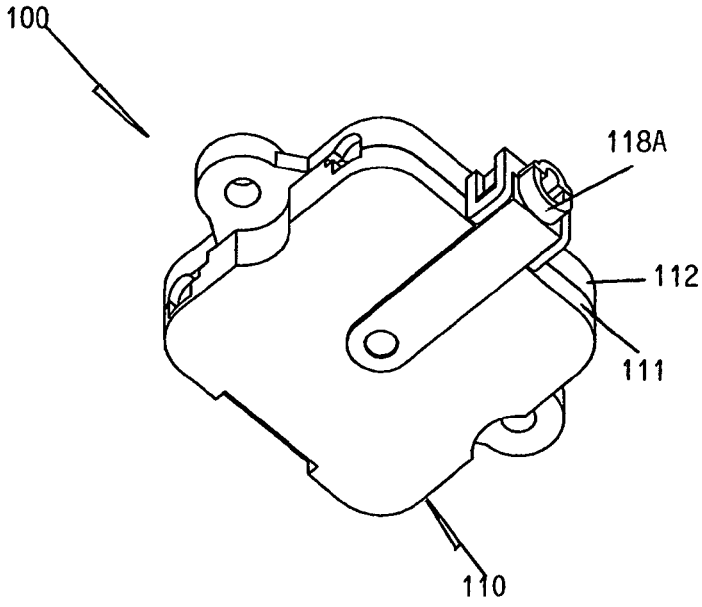
FIG. 2 is a bottom perspective view of the rotary switch of FIG. 1.
Figure 3:
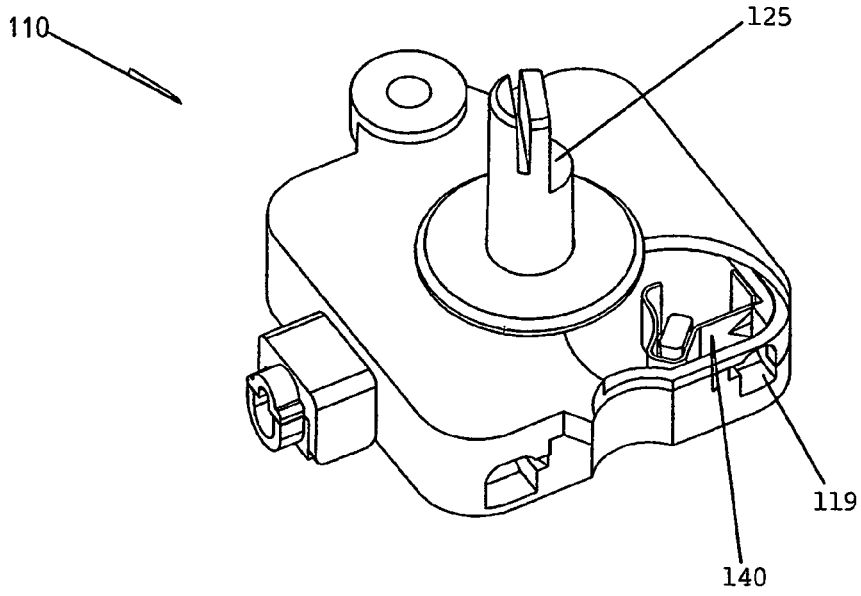
FIG. 3 is another top perspective view of the rotary switch of FIG. 1, partially broken to show an internal fixed contact.
Figure 4:
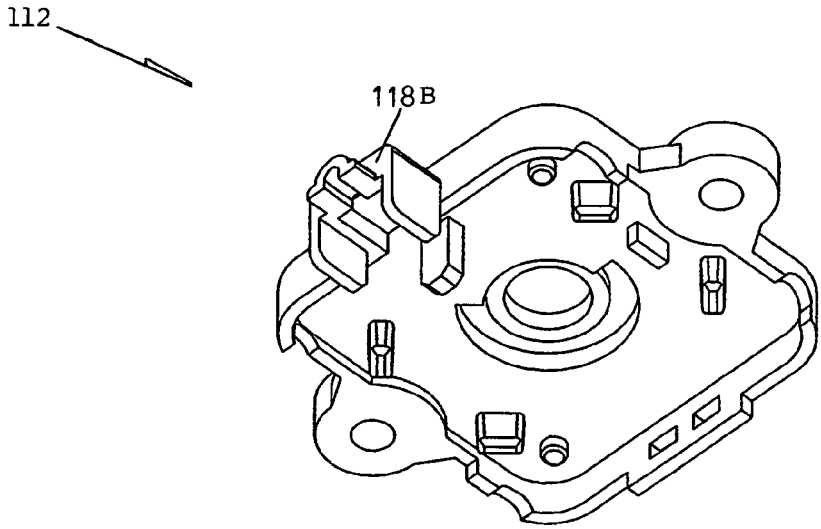
FIG. 4 is a bottom perspective view of a lid of the rotary switch of FIG. 1.
Figure 5:
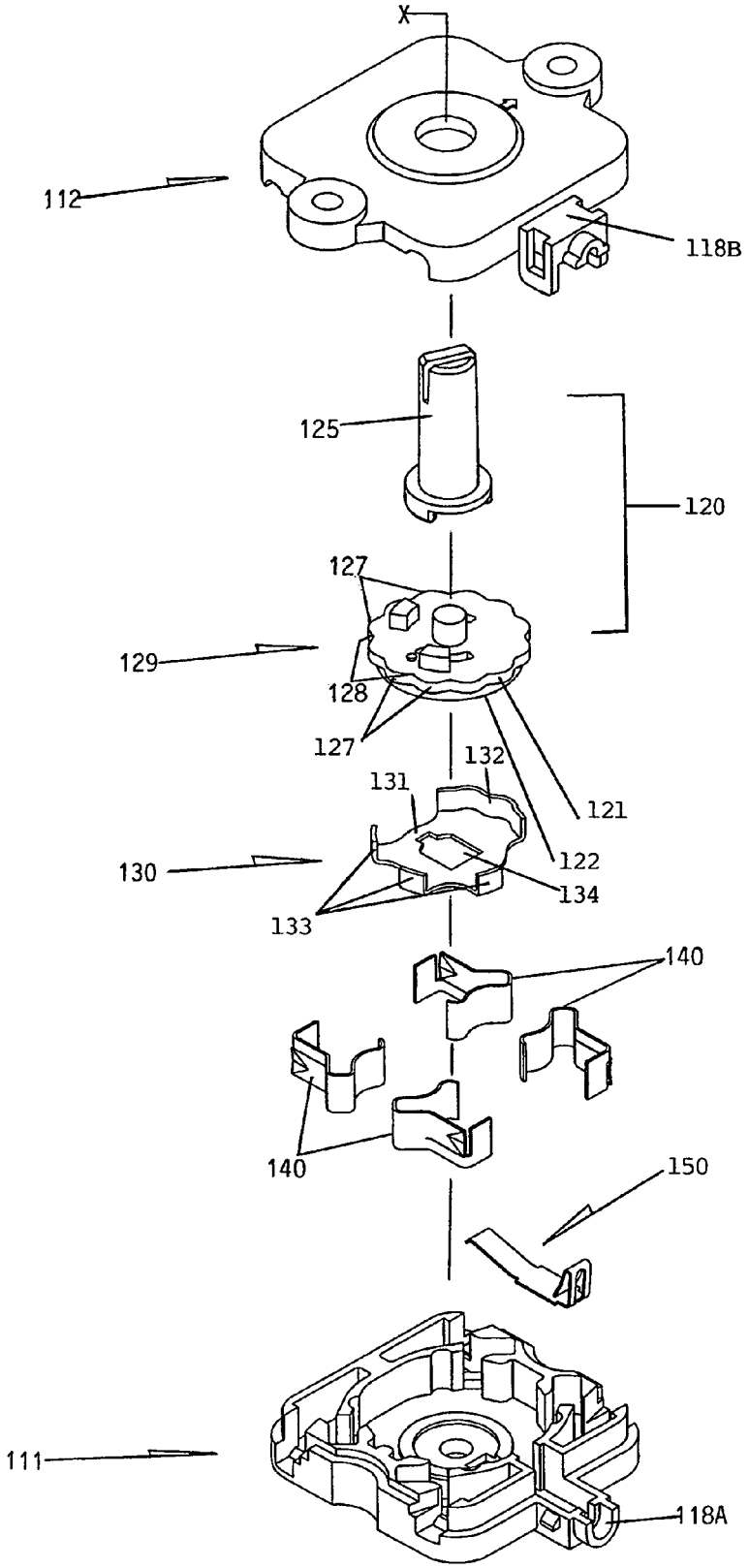
FIG. 5 is an exploded top perspective view of the rotary switch of FIG. 1.
Figure 6:
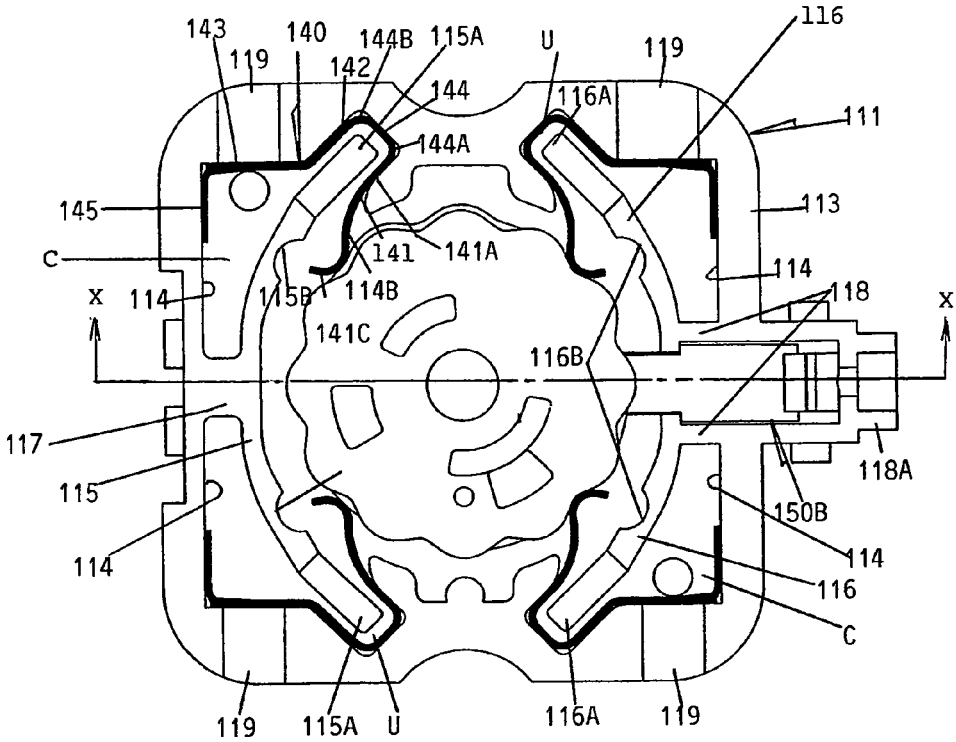
FIG. 6 is a top plan view showing internal parts of the rotary switch of FIG. 5.
Figure 7:
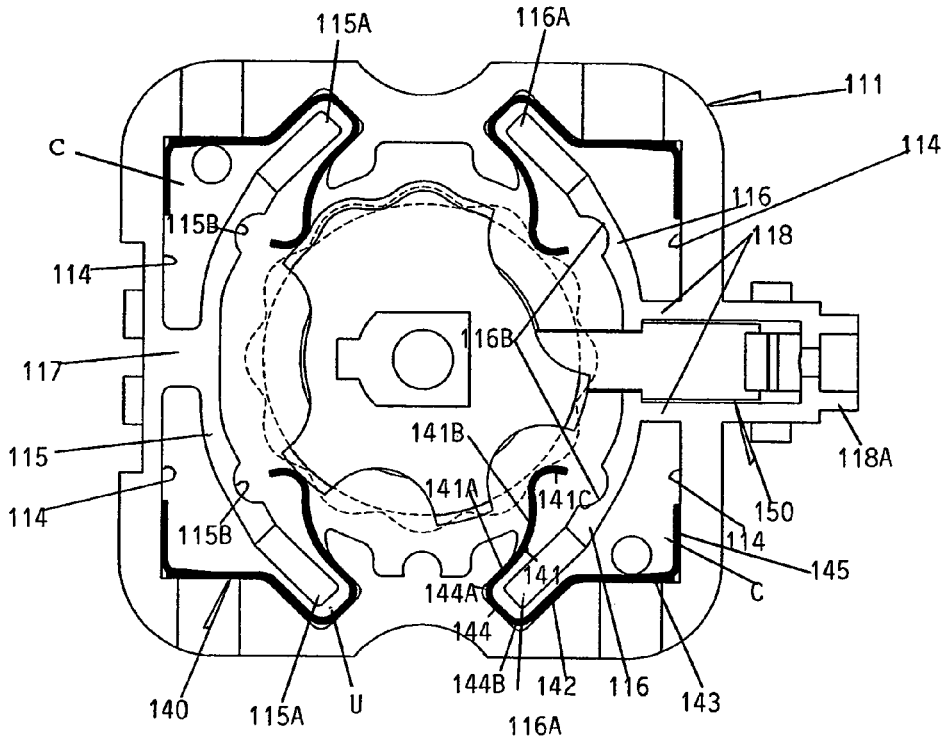
FIG. 7 is a top plan view similar to FIG. 6, showing internal parts of the rotary switch of FIG. 5.
Figure 8:
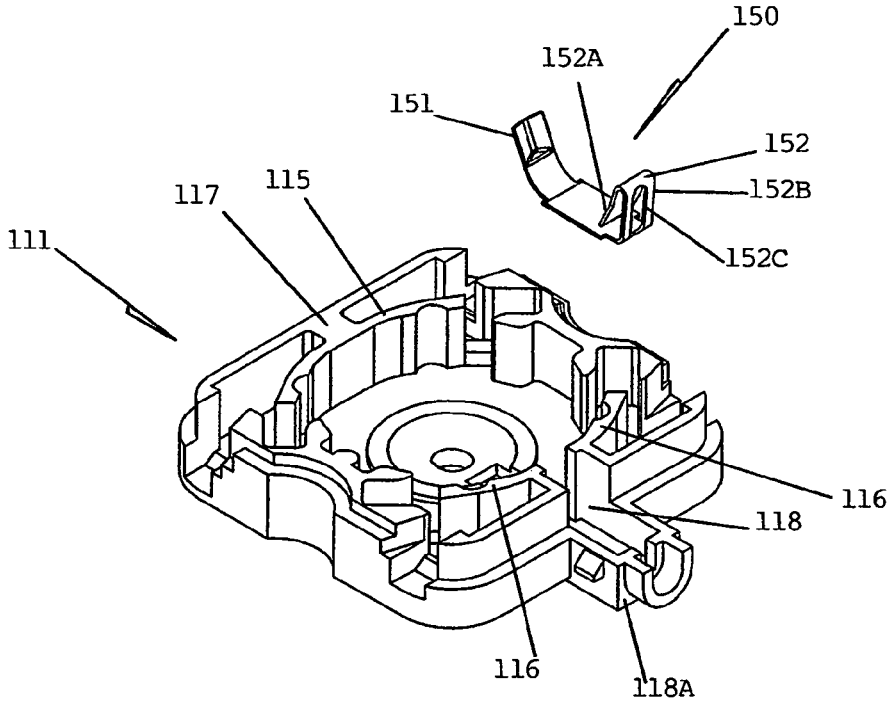
FIG. 8 is a top perspective view of a casing base of the rotary switch of FIG. 5 and a fixed contact on one side thereof.
Figure 9:
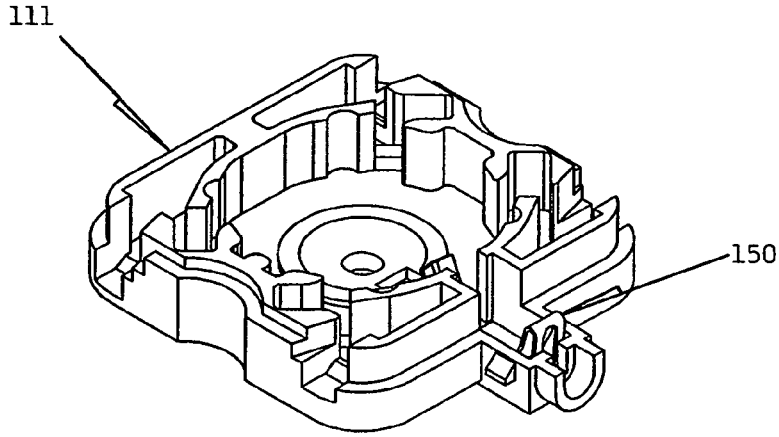
FIG. 9 is a top perspective view similar to FIG. 8, showing the fixed contact located in the casing base.
Figure 10:
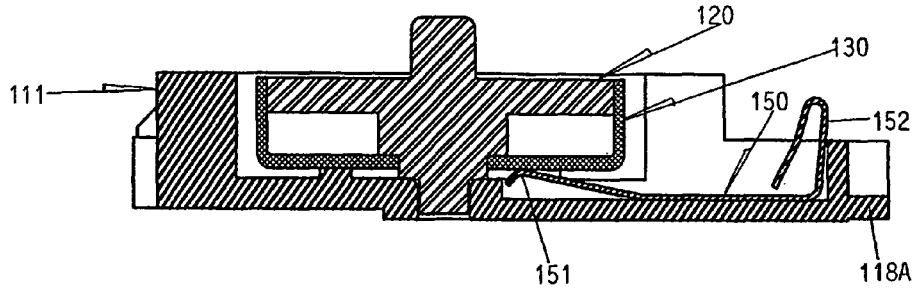
FIG. 10 is a cross-sectional view of the rotary switch of FIG. 6, taken along line X-X.
Figure 11:
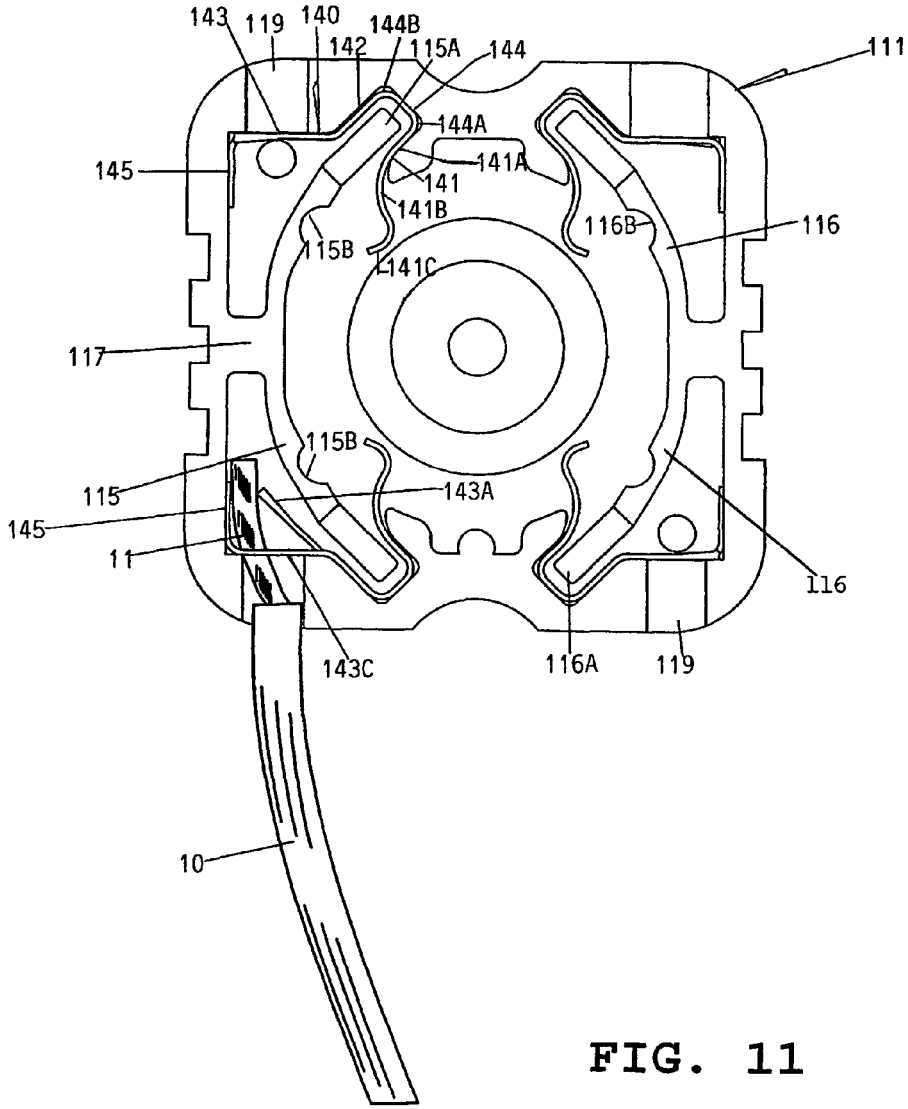
FIG. 11 is a simplified top plan view showing internal parts of the rotary switch of FIG. 5 and an electrical cable connected thereto.
Figure 12:
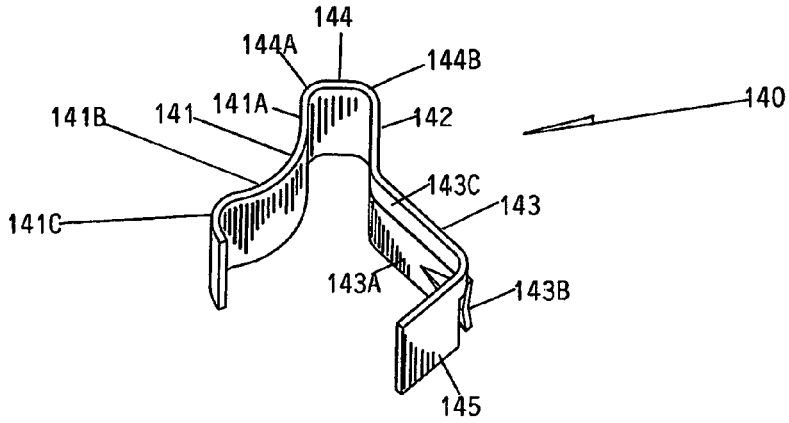
FIG. 12 is a perspective view of a fixed contact of the rotary switch of FIG. 5.

Referring to the drawings, there is shown an electrical rotary switch 100 embodying the invention, which has a generally flat square casing 110, an internal rotor 120, a moving contact 130 mounted on the rotor 120 and four fixed contacts 140 provided within respective corners of the casing 110. The casing 110 is formed by a generally flat square base 111 and a matching lid 112 closing an open upper side of the base 111. There is a hole 119 at each of the four corners of the casing 110, through which an external electrical cable 10 may be inserted into the casing 110 for connection with the relevant fixed contacts 140 as hereinafter described.

The rotor 120 is supported centrally inside the casing 110 for rotation about a central axis X (vertical as shown) over 360° in opposite directions. The rotor 120 has a generally circular disc-like body 129 and a central shaft 125 connected co-axially therewith. The shaft 125 projects vertically upwardly from the rotor body 129 out of the casing 110 through the lid 112 along the axis X to enable manual rotation of the rotor 120, and is usually fitted with a turning knob (not shown) to facilitate turning.

The rotor body 129 has a peripheral flange 121 surrounding the axis X and a flat open lower end 122 having an end side or surface radially extending about the axis X. The flange 121 has an undulating or wavy profile formed by a ring of twelve evenly-spaced arcuate crests 127, with a flat V-shaped valley 128 between adjacent crests 127. The twelve valleys 128 are situated at, say, $1^{st}$ to $12^{th}$ angular position about the axis X. The fixed contacts 140 bear resiliently against the valleys 128 to define twelve stable angular positions for the rotor 120 and to slidingly make/break contact with/from the moving contact 130.

The moving contact 130 has a generally flat horizontal main body or base 131 and four integral rim parts or tabs 132 and 133 upstanding therefrom at the $1^{st}$ to $3^{rd}$, $6^{th}$, $8^{th}$ and $10^{th}$ valley positions. The moving contact 130 fits from below over the lower end 122 of the rotor body 129, with its base 131 lying on the lower end surface and its tabs 132 and 133 lying around the side and meeting the rotor's peripheral flange 121. An axial projection at the rotor's lower end 122 engaging through a central aperture 134 of the base 131 is expanded by heat to secure the moving contact 130 on the rotor 120.

The wider contact tab 132 extends continuously over the $1^{st}$ to $3^{rd}$ valley positions, having a wavy profile matching with that of an adjacent portion of the rotor's flange 121 but slightly radially expanded therefrom for contact with/by the fixed contacts 140. Each of the other three contact tabs 133 is much narrower and is generally flat as shown, or may be slightly V-shaped, to guard the corresponding valley 128 likewise for contact with/by the fixed contacts 140.

In general, the moving contact 130 is mounted fast on the rotor 120 for rotation therewith, with its base 131 and contact tabs 132 and 133 enclosing the rotor's lower end 122 and the contact tabs 132 and 133 slightly radially protruding beyond the rotor's flange 121 for contact with/by the fixed contacts 140.

The moving contact 130 is produced by way of a deep-draw manufacturing process that involves the use of a plug 201 and a die 202, as illustrated in FIGS. 14, 15 and 16A to 16D. The plug 201 has a uniform cross-section which is equivalent to the inner cross-section of the moving contact 130 as defined by the inner surfaces of its contact tabs 132 and 133 and its free edges extending between the tabs 132 and 133.

The die 202 has a central through bore or cavity 203 which has a cross-section same as the outer cross-section of the moving contact 130 as defined by the outer surfaces of its contact tabs 132 and 133 and its free edges extending between the tabs 132 and 133. The cross-section is constant at the top end of the cavity 203 over a relatively short distance greater than the thickness of the moving contact 130, and then gradually widens in the downward direction.

Production of the moving contact 130 starts with a blank 130D of metal material such as copper alloy, which is originally stamped out from a much larger base sheet to have a shape as the development of the moving contact 130. The blank 130D has a base 131D, radially projecting from which there are one wider part 132A and three narrower parts 133A.

Figure 16A:
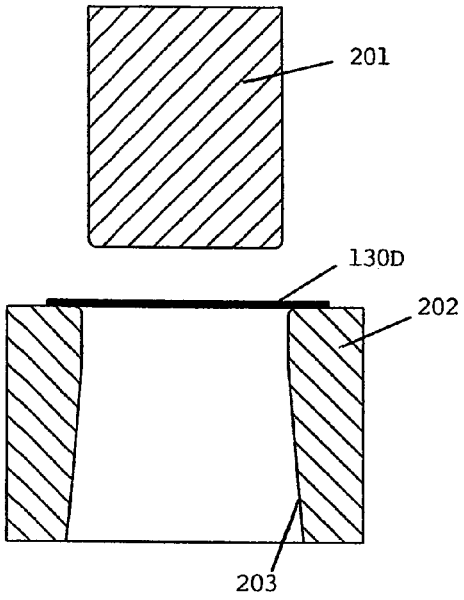
FIGS. 16A to 16D are cross-sectional side views which illustrate sequentially the manufacturing process of FIGS. 14 and 15.
Figure 16B:
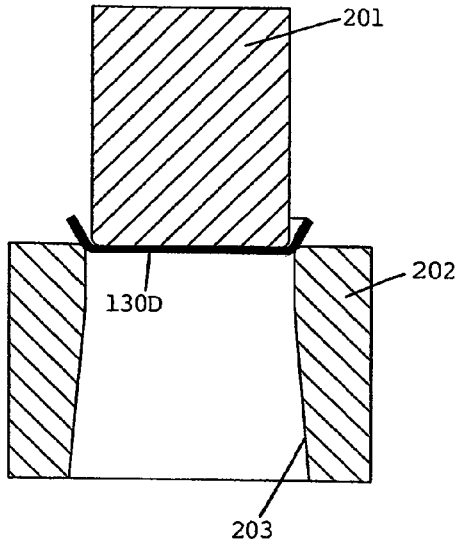
Figure 16C:
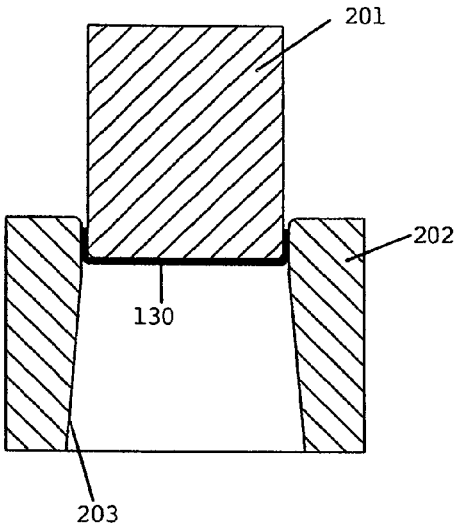
Figure 16D:
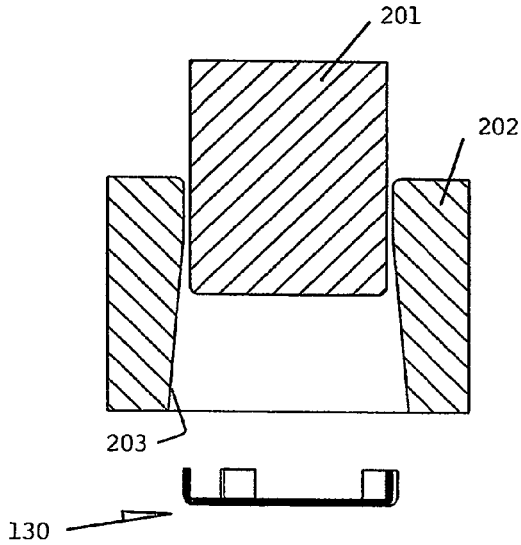

To commence the deep-draw process, the blank 130D is initially placed on the upper end of the die 202, or upon the lower end of the plug 201, at the right position aligned with the plug 201 or as determined by reference to its central aperture 134 (FIG. 16A). Upon pressing down of the plug 201 into the cavity 203 of the die 202, the blank 130D is folded with its protruding parts 132D and 133D about the edge of the lower end of the plug 201 through 90° until they turn vertically upwards (FIGS. 16B to 16C), whereupon the moving contact 130 is formed. As the wider protruding part 132D is being folded, it is simultaneously stretched to acquire the wavy profile as mentioned above. Pressing of the plug 201 deeper to reach the wider lower end of the cavity 203 allows release of the contact 130 from the plug 201 (FIG. 16D).

The four fixed contacts 140 are located within respective corners of the casing 110, laterally around the rotor 120 and moving contact 130 for short-circuiting by the moving contact 130, whereby the switch 100 is closed. The fixed contacts 140 have identical construction and are inter-changeable.

Each fixed contact 140 is formed by a bent copper strip which includes a series of first, second and third integrally connected sections 141, 142 and 143, taken in the direction outwardly from the axis X. The first section 141 bears resiliently against the rotor's peripheral flange 121 for sliding contact with any one of the moving contact tabs 132 and 133. The second section 142 turns in one direction (anti-clockwise) from the first section 141 through an angle larger than 135°, which in this particular embodiment is an angle of substantially 180° whereby the two sections 141 and 142 are spaced apart by a parallel gap. The third section 143 turns in the opposite direction (clockwise) from the second section 142 for connection with an external electrical cable 10, through an angle smaller than 90°, which in this particular embodiment is an angle between 40° and 50° and more preferably 45°.

The second section 142 of each fixed contact 140 turns from the first section 141 through two curved bends 144A and 144B, each of an angle of substantially 90°. The two bends 144A and 144B are integrally inter-connected by a relatively short, substantially flat, intermediate fourth section 144 of the fixed contact 140, together forming a generally rectangular U-bend 144U of the contact 140.

The first section 141 has a substantially flat first portion 141A adjacent the second section 142 (or adjoining the fourth section 144) and a curved second portion 141B which is considerably longer than the first portion 141A. The second portion 141B is curved smoothly outwardly from the second section 142 (or the fourth section 144) and then smoothly inwardly to provide a convex end 141C bearing resiliently against the rotor 120 for sliding contact with any one of the moving contact tabs 132 and 133. The first section 141 is sufficiently long and is shaped as described to achieve an optimum resilience and contact pressure upon the rotor 120 and moving contact 130.

The second section 142 is considerably shorter than the first section 141 and, more specifically, is about half the length of the first section 141.

Both of the second and third sections 142 and 143 are substantially flat, and so is an integrally connected fifth section 145 of the fixed contact 140, at the free end thereof. The fifth section 154 turns in said one direction (anti-clockwise) through an angle of substantially 90° from the third section 143.

In general, each of the fixed contacts 140 is shaped to extend over an angle or to subtend an angle that is larger than 180°, such that it resembles an open loop having a single open side, as shown in the drawings.

The third contact section 143 is partially cut along almost its entire length and along about two-third of its width, together along an L-shaped path, to form a rectangular tab 143A on one side. The fifth contact section 145 remains integrally connected by an integral link 143C which is provided on the other side by the remaining one-third by width of the third contact section 143. The tab 143A is separate from the rest of the third contact section 143 by a substantially L-shaped cut which extends partially along the length and width of the same section 143. The tab 143A and the link 143C are situated side-by-side in a direction transversely of the contact section 143, occupying the entire width thereof.

The contact tab 143A is resiliently bendable out of the plane of the third contact section 143 about an uncut, integrally connected end thereof adjoining the second contact section 142. The free end of the contact tab 143A is situated adjacent the fifth contact section 145 and is forged with a central V-shaped beak 143B for pressing and gripping a cable end against the fifth contact section 145. The tab 143A extends from its connected end to its free end in a direction parallel to the link 143C.

Referring to the casing 110 or the base 111 thereof, its peripheral wall 113 is closed except at the four corner holes 119. Each internal corner 114 of the casing wall 113 is shaped to match the outer profile of the associated fixed contact 140, against which the contact 140 is located and hence fixed in position. The casing base 111 includes internally a broken annular partition extending generally around the rotor 120, which is formed by a longer partition 115 on one side of the rotor 120 and a pair of shorter partitions 116 on the opposite side. The two shorter partitions 116 together mirror the longer partition 115.

The longer partition 115 has opposite ends 115A, and each shorter partition 116 has an outer end 116A opposite that of the other partition 116. Each of these four partition ends 115A/116A extends into a generally rectangular bay on one side of a corresponding adjacent casing corner 114, forming with that bay a generally rectangular U-shaped channel U. Conversely, the channel U is defined by the inner side of the casing wall 113 extending by its bay along opposite sides and round the said partition end 115A/116A.

Each channel U loosely receives the corresponding fixed contact 140 at the same casing corner 114 by its first section 141 (first portion 141A only), fourth section 144 and second section 142, with the associated partition end 115A/116A running between the first and the second sections 141 and 142 almost or generally along the entire length of the gap therebetween. Within the channel U, the first section 141 in part and the entire second section 142 of the fixed contact 140 are in contact with the wall of the casing corner 114 (i.e. outer wall of the channel U), whilst they are spaced apart from the partition end 115A/116A (i.e. inner wall of the channel U) such that they are bendable closer to each other about the U-bend 144U.

The third contact section 143 extends right behind and across the corresponding casing hole 119, with the fifth contact section 145 lying flat against the adjoining 90°-turned surface of the casing corner 114. The casing hole 119 exposes only the contact tab 143A of the third contact section 143 such that as a bare end 11 of the cable 10 is being inserted into the casing 110 through the hole 119, the cable end 11 pushes and bends the contact tab 143A inwardly out of the plane of the third contact section 143. This results in or leaves behind a void or aperture in the contact section 143, which is open on one side of the contact section 143 opposite the link 143C and through which the cable end 11 can enter further into the casing 110.

Figure 13:
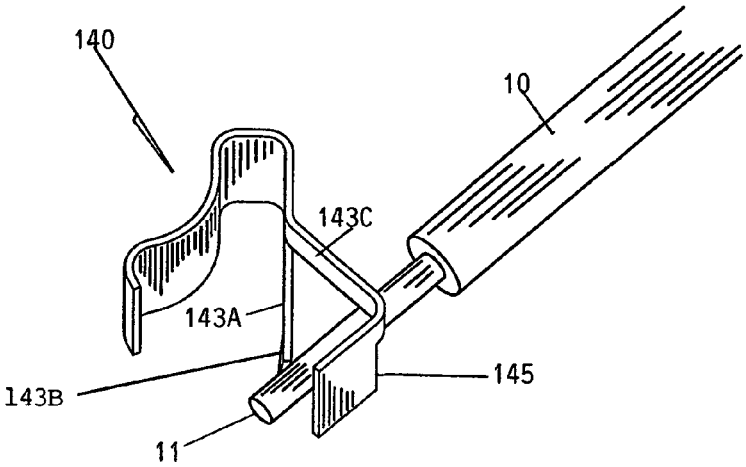
FIG. 13 is a perspective view similar to FIG. 12, showing an electrical cable connected to the fixed contact.
Figure 14:
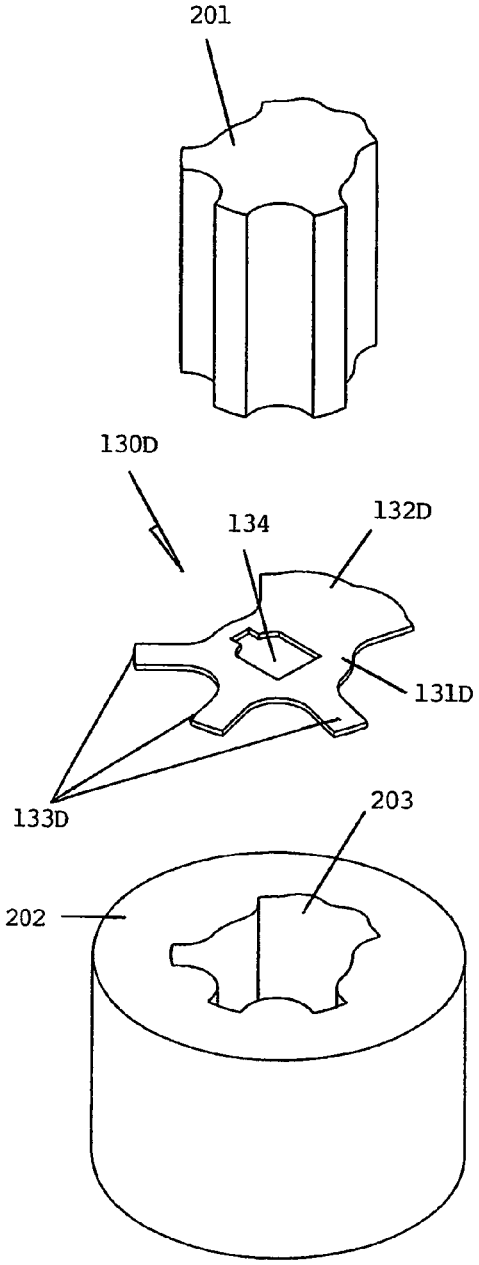
FIGS. 14 and 15 are perspective views showing the manufacturing process of a moving contact of the rotary switch of FIG. 5.
Figure 15:
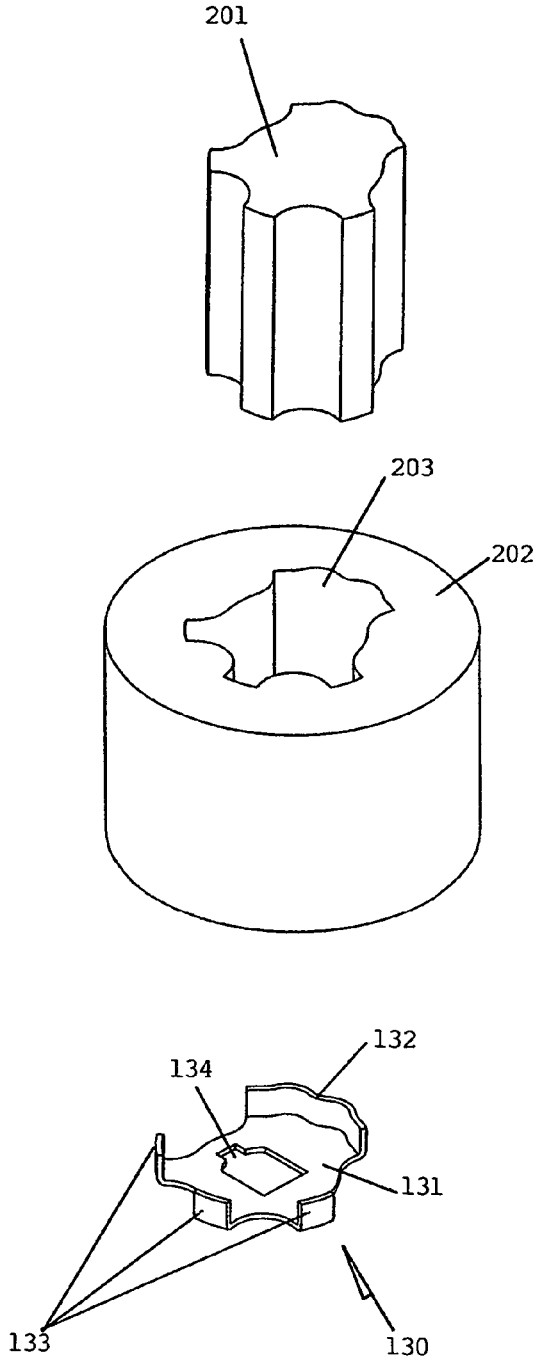

Under the force of its resilience, the bent contact tab 143A is sprung and presses upon the cable end 11 firmly against the adjacent fifth contact section 145, whereby the cable end 11 is automatically clamped on opposite sides between the contact tab 143A and the fifth contact section 145. The cable end 11 is pressed by the bent contact tab 143A against the surface of the fifth contact section 145 that is adjacent and faces the tab 143A. The contact tab 143A acts or bites, with the inner side of its V-shaped beak 143B, inwardly at an acute angle at the cable end 11, whereby the cable end 11 is firmly gripped against withdrawal. This gives rise to a double-sided connection of the cable end 11 to the fixed contact 140 (FIG. 13), that being a reliable good contact connection upon the cable end 11.

Each of the partition 115 and the pair of shorter partitions 116 taken together is connected at mid-length to an opposed part of the corresponding adjacent casing wall 113 by an integral web 117/118, together defining a substantially closed cavity C at each casing corner 114 behind the associated third contact section 143 or casing hole 119. One web 117 is solid, whilst the other web 118 is hollow or double-walled to thereby divide the two shorter partitions 116 from each other.

By extending between the rotor 120 and first contact section 141 and the third contact section 143, the partition 115/116 blocks and thus protects the rotor 120 and first contact section 141 against damage by the cable end 11 or the contact tab 143A bent by the cable end 11 in case of over insertion of the cable end 11 into the casing hole 119. If the cable end 11 is inserted too deeply, it may come into contact with the moving contact 130 on the rotor 120 and cause a short-circuit fault or electric shock, and this is also safeguarded by the partition 115/116.

With regard to the fixed contacts 140, the second portion 141B (including convex end 141C) of their first contact section 141 protrudes out of the associated channel U and is exposed for contacting the rotor 120 and moving contact tabs 132 and 133.

The first contact section 141 is connected relatively close to the third contact section 143 via the relatively short second contact section 142 and U-bend 144U. The channel U is sufficiently wide to permit inward bending of the second contact section 142 about the U-bend 144U. As the contact tab 143A (i.e. a major part the third contact section 143) is being bent inwardly by the cable end 11 upon insertion, the force of bending acts directly upon the second contact section 142, which is in turn bent inwardly to pass on or transmit the bending force to the first contact section 141 via the U-bend 144U, thereby suitably strengthening the force of the first contact section 141 bearing resiliently upon the rotor 120 and moving contact tabs 133.

By reason of their construction and arrangement as herein described, the fixed contacts 140 can be made considerably shorter and smaller thereby allowing a material reduction in the overall size of the rotary switch 100, whilst their separation, primarily in terms of creepage distance, as between each and the other contact(s) can be maintained at or extended to at least or longer than 6 mm. This is well above the minimum contact separation meeting the relevant official safety standard requirements for electrical switches or the like, without compromising on the contact performance or voltage/current rating.

The subject switch 100 includes an additional fifth side fixed contact 150 which extends into the switch casing 110 through one side thereof, along a path midway between the two fixed contacts 140 on that side.

The side fixed contact 150 is provided by an elongate copper strip which has a suitably shaped inner end 151 in continuous sliding contact, from below, with the base 131 of the moving contact 130 on the rotor 120 and an outer end 152 for connection of an external electrical cable. The outer contact end 152 has a series of two, first and second end sections 152A and 152B which are turned/folded back inwardly, with the second section 152B upstanding and the first section 152A sloping downwardly therefrom. The second section 152B is formed with a hole 152C through which a bare end of the cable can be inserted.

Upon insertion, the cable end pushes and bends the first end section 152A inwardly, which in turn by virtue of its resilience presses the inserted cable end firmly against the body of the fixed contact 150 on the opposite side. The cable end is thus automatically clamped between the first end section 152A and the body of the contact 150, with the end section 152A acting or biting inwardly at an acute angle at the cable end to thereby firmly grip the cable end against withdrawal. The resulting double-sided connection of the cable end to the contact 150 is a reliable good contact connection.

The side of the switch casing 110 on which the fifth fixed contact 150 is located is where the two shorter partitions 116 and the web 118 are. Generally stated, each of the two fixed contacts 140 on this casing side has an open side facing that of the other fixed contact 140, between which open sides the fixed contact 150 runs. This arrangement allows the contact 150 to be separated from the two fixed contacts 140 on its opposite sides by a distance, primarily in terms of creepage distance, of at least 3 mm to meet the relevant official safety standard requirements for electrical switches or the like, without compromising on the contact performance or voltage/current rating.

The double-walled web 118 develops into a channel-shaped integral protrusion 118A projecting laterally from the base 111 of the switch casing 110, which is closed by a matching integral protrusion 118B of the lid 112. The lid protrusion 118B has a pair of loops on its opposite sides for latching respective ears on the base protrusion 118A, together forming a tube 118A/118B substantially aligned in terms of thickness with the casing 110, which houses and locates the side contact 150.

The side contact 150 extends with its outer end 152 from within the tube 118A/118B and then passes through and beyond the web 118 with its inner end 151 reaching underneath the rotor 120, in contact with moving contact 130.

The side contact 150 is housed within the same interior of the switch casing 110 as the other corner fixed contacts 140 as between the base 111 and the lid 112 of the casing 110, such that fitting of all five fixed contacts 140 and 150 inside the casing 110 can be performed in the same assembling procedure.

By its inner end 151 maintained in continuous contact with the moving contact 130 irrespective of the position of the rotor 120, the extra fixed contact 150 in conjunction with the wider moving contact tab 132 spanning three valley or rotor positions, are useful in providing a continuous or always-on connection during switching between those rotor positions. Such a connection is preferred for electronic IC circuits and in particular for the VCC pin connection, whose continuity is often essential to ensure a smooth or uninterrupted operation.

The invention has been given by way of example only, and various modifications of and/or alterations to the described embodiment may be made by persons skilled in the art without departing from the scope of the invention as specified in the appended claims.

What is claimed is:

1. An electrical rotary switch comprising:

a casing;

a rotor supported within the casing for rotation about an axis and having a rotor periphery surrounding the axis;

a moving contact mounted on the rotor for rotation with the rotor and having a plurality of connected parts adjacent the rotor periphery; and a plurality of fixed contacts located laterally of the rotor for short-circuiting by the moving contact, wherein at least one of the fixed contacts comprises first, second, and third integrally connected sections, the first section bearing resiliently against the rotor periphery for sliding contact with the moving contact parts, the second section turning through an angle larger than 135° from the first section, and the third section turning through an angle smaller than 90° from the second section for connection of a first electrical cable, wherein the first section is longer than the second section.

2. The electrical rotary switch as claimed in claim 1, wherein the at least one fixed contact subtends an angle larger than 180°.

3. The electrical rotary switch as claimed in claim 1, wherein the second section turns from the first section in a first direction and the third section turns from the second section in a second direction, opposite the first direction.

4. The electrical rotary switch as claimed in claim 1, wherein the second section turns from the first section through an angle of substantially 180°.

5. The electrical rotary switch as claimed in claim 4, wherein the second section turns from the first section through two curved bends, each curved bend having an angle of substantially 90°.

6. The electrical rotary switch as claimed in claim 5, wherein the two curved bends are integrally inter-connected by an intermediate section of the at least one fixed contact, the intermediate section being substantially flat.

7. The electrical rotary switch as claimed in claim 1, wherein the second section is approximately one-half as long as the first section.

8. The electrical rotary switch as claimed in claim 1, wherein the first section has a substantially flat first portion adjacent the second section and a curved second portion which is curved smoothly outwardly from the second section and then smoothly inwardly, thereby forming a convex end bearing resiliently against the rotor periphery for sliding contact with the moving contact part, the second portion being longer than the first portion.

9. The electrical rotary switch as claimed in claim 1, wherein the second section is substantially flat.

10. The electrical rotary switch as claimed in claim 1, wherein the third section turns from the second section through an angle between 40° and 50°.

11. The electrical rotary switch as claimed in claim 1, wherein the casing has an internal partition that extends between the first section and the second section.

12. The electrical rotary switch as claimed in claim 11, wherein the partition extends along almost all of a gap between the first section and the second section.

13. The electrical rotary switch as claimed in claim 12, wherein the casing has a wall that extends along opposite sides and around an end of the partition, the casing, the wall, and the partition defining a channel receiving a part of the first and second sections.

14. The electrical rotary switch as claimed in claim 13, wherein the part of the first and second sections is in contact with the wall.

15. The electrical rotary switch as claimed in claim 1, wherein the casing has a hole behind which the third section is located, the third section being resiliently bendable inwardly by the first electrical cable upon insertion of the first electrical cable through the hole, thereby gripping the first electrical cable against withdrawal of the first electrical cable from the hole.

16. The electrical rotary switch as claimed in claim 1, each of the fixed contacts being separated from other fixed contacts by a distance of at least 6 mm.

17. The electrical rotary switch as claimed in claim 1, including first and second fixed contacts, wherein the rotor has a side circumferentially extending about the axis, and the moving contact has a portion at the side of the rotor and connected with parts of the moving contact, and including a third fixed contact located generally between the first and second fixed contacts, the third fixed contact having an inner part in continuous sliding contact with the portion of the moving contact and an outer part for connection to a second electrical cable.

18. The electrical rotary switch as claimed in claim 17, wherein each of the first and second fixed contacts subtends an angle larger than 180° and has an open side facing the other of the first and second fixed contacts, the third fixed contact being located between the open sides of the first and second fixed contacts.

19. The electrical rotary switch as claimed in claim 17, wherein the first and second fixed contacts and the third fixed contact are located within a common interior space of the casing.

20. The electrical rotary switch as claimed in claim 19, wherein the casing has two parts connected together and defining the interior space therebetween.

21. The electrical rotary switch as claimed in claim 17, wherein the third fixed contact is separated from the first and second fixed contact by a distance of at least 3 mm.

22. The electrical rotary switch as claimed in claim 1, wherein the casing has a substantially flat square shape, having four corners, each fixed contact being housed in a respective corner of the casing.

23. An electrical rotary switch comprising:

a casing;

a rotor supported within the casing for rotation about an axis and having a rotor periphery surrounding the axis;

a moving contact mounted on the rotor for rotation with the rotor and having a plurality of connected parts adjacent the rotor periphery; and a plurality of fixed contacts located laterally of the rotor for short-circuiting by the moving contact, wherein at least one of the fixed contacts comprises first, second, and third integrally connected sections, the first section bearing resiliently against the rotor periphery for sliding contact with the moving contact parts, the second section turning through an angle larger than 135° from the first section, and the third section turning through an angle smaller than 90° from the second section for connection of an electrical cable, wherein the casing has an internal partition that extends between the rotor, the first section, and the third section.

24. The electrical rotary switch as claimed in claim 23, wherein the casing has a wall connected to the partition, the casing, the wall, and the partition defining a substantially closed cavity behind the third section.

25. An electrical contact for an electrical switch, comprising:

a contact portion for making contact with or breaking contact from another electrical contact in an electrical switch to perform switching; and a terminal portion connected to the contact portion for connection to an electrical cable, wherein the terminal portion comprises:

a first section having a tab and a link, the tab being bendable out of a plane of the first section, leaving a void in the first section; and a second section integrally connected to the first section by the link and located adjacent the tab such that, upon being bent out of the plane of the first section by an end of the electrical cable passing through the void, the tab resiliently grips and presses the electrical cable end against the second section, resulting in the end of the electrical cable being connected on opposite sides of the end of the electrical cable.

26. The electrical contact as claimed in claim 25, wherein the second section has a surface adjacent the tab and facing the tab, while bent, against which surface the tab, while bent, presses the end of the electrical cable.

27. The electrical contact as claimed in claim 26, wherein the second section turns from the first section through an angle of about 90°.

28. The electrical contact as claimed in claim 25, wherein the tab has an integrally connected first end about which the tab is bendable, and a free second end adjacent the second section for gripping and pressing the end of the electrical cable against the second section.

29. The electrical contact as claimed in claim 28, wherein the tab extends from the first end to the second end in a direction substantially parallel to the link.

30. The electrical contact as claimed in claim 25, wherein the tab and the link are located side-by-side in a direction transverse to the first section.

31. The electrical contact as claimed in claim 30, wherein the tab and the link occupy all of the width of the first section.

32. The electrical contact as claimed in claim 25, wherein the tab is separated from the first section by a substantially L-shaped cut.

33. The electrical contact as claimed in claim 32, wherein the substantially L-shaped cut extends partially along the length and width of the first section.

34. The electrical contact as claimed in claim 25, wherein the void is open on one side of the first section, opposite the link.

35. The electrical contact as claimed in claim 25, wherein each of the first and second sections is substantially planar.

36. The electrical contact as claimed in claim 25, wherein the second section is located at a free end of the electrical contact.

37. An electrical rotary switch comprising:

a casing;

a rotor supported within the casing for rotation about an axis and having a rotor sided circumferentially extending about the axis and a rotor periphery surrounding the axis, the rotor periphery having an undulating profile;

a moving contact mounted on the rotor for rotation with the rotor; and a plurality of fixed contacts located laterally of the rotor and bearing resiliently against the rotor periphery for sliding contact with the moving contact and short-circuited by the moving contact, wherein the moving contact comprises a single piece of metal including a base facing the rotor and generally perpendicular to the axis, and a plurality of parts adjacent the rotor periphery and generally parallel to the axis, for contacting the fixed contacts, at least one of the parts of the moving contact having an undulating profile matching the undulating profile of the rotor periphery.

38. The electrical rotary switch as claimed in claim 37, wherein the undulating profile of the rotor periphery comprises alternating crests and valleys, and the undulating profile of the at least one part of the moving contact extends continuously over at least two neighboring valleys and the crest adjacent to each of the two neighboring valleys of the rotor periphery.

39. The electrical rotary switch as claimed in claim 37, wherein the undulating profile of the rotor periphery comprises alternating crests and valleys, and the undulating profile of the at least one part of the moving contact comprises at least two neighboring valleys matching two neighboring valleys of the rotor periphery.

40. The electrical rotary switch as claimed in claim 37, wherein the moving contact fits over the rotor, with the base lying on the rotor, a periphery of the base meeting the rotor periphery.

41. The electrical rotary switch as claimed in claim 37, wherein the undulating profile of the at least one part of the moving contact is expanded from the undulating profile of an adjacent part of the rotor periphery for contact by the fixed contacts.

42. The electrical rotary switch as claimed in claim 37, wherein the moving contact is produced by a deep-draw manufacturing process from a blank of material.

43. The electrical rotary switch as claimed in claim 37, wherein the casing has a substantially flat square shape, having four corners, each fixed contact being housed in a respective corner of the casing.

44. An electrical rotary switch comprising:

a casing;

a rotor supported within the casing for rotation about an axis and having a rotor side circumferentially extending about the axis and a rotor periphery surrounding the axis, wherein the casing has a thickness generally parallel to the axis;

a moving contact mounted on the rotor for rotation with the rotor, having a base adjacent the rotor and a plurality of parts adjacent the rotor periphery;

at least two fixed contacts located laterally of the rotor, bearing resiliently against the rotor periphery for sliding contact with the parts of the moving contact, and short-circuited by the parts of the moving contact; and an additional fixed contact, located generally between first and second fixed contacts of the at least two fixed contacts, and including an inner portion in continuous sliding contact with the base of the moving contact and an outer portion for connection to an electrical cable, wherein the at least two fixed contacts and the additional fixed contact are located within interior space of the casing, the casing includes a tubular protrusion projecting laterally from the casing and housing the additional fixed contact, the tubular protrusion and the first and second fixed contacts of the at least two fixed contacts being centrally located with respect to the thickness of the casing, and the tubular protrusion and the additional fixed contact located within the tubular protrusion are located between and aligned with the first and second fixed contacts of the at least two fixed contacts.

45. The electrical rotary switch as claimed in claim 44, wherein the casing includes a base and a lid connected together and defining the interior space of the casing.

46. The electrical rotary switch as claimed in 44, wherein the outer portion of the additional fixed contact has integrally connected first and second parts for gripping an end of the electrical cable between the first and second parts, the first part being bendable inwardly by the end of the electrical cable, upon insertion, to engage the end of the electrical cable at an angle inwardly and to press the end of the electrical cable against the second part.

47. The electrical rotary switch as claimed in claim 46, wherein the first part of the outer portion of the additional fixed contact is folded backwards and points at an angle inwardly at the second part, for connecting the end of the electrical cable.

48. The electrical rotary switch as claimed in claim 46, wherein the outer portion of the additional fixed contact has a hole between the first and second parts for insertion of the end of the electrical cable to a position between the first and second parts.

49. The electrical rotary switch as claimed in claim 44, wherein the casing has a substantially flat square shape, having four corners, each of the at least two fixed contacts being housed in a respective corner, and having four sides, the additional fixed contact extending through one of the four sides.

* * * * *